US007115002B1

(12) United States Patent
Gentry

(10) Patent No.: US 7,115,002 B1
(45) Date of Patent: Oct. 3, 2006

(54) ELECTRICAL CONTACT AND CONNECTOR ASSEMBLY

(75) Inventor: John T. Gentry, Springfield, MO (US)

(73) Assignee: Positronic Industries, Inc., Springfield, MO (US)

( * ) Notice: Subject to any disclaimer, the term of this patent is extended or adjusted under 35 U.S.C. 154(b) by 0 days.

(21) Appl. No.: 11/098,236

(22) Filed: Apr. 4, 2005

(51) Int. Cl.
*H01R 13/187* (2006.01)

(52) U.S. Cl. ..... 439/847; 439/851

(58) Field of Classification Search ..... 439/847, 439/852

See application file for complete search history.

(56) References Cited

U.S. PATENT DOCUMENTS

| | | | | |
|---|---|---|---|---|
| 1,968,480 | A | | 7/1934 | Draving |
| 2,488,652 | A | | 11/1949 | Adams |
| 3,504,331 | A | * | 3/1970 | Anderson ..... 439/847 |
| 3,588,783 | A | * | 6/1971 | Neman ..... 439/847 |
| 3,654,595 | A | * | 4/1972 | Curr ..... 439/847 |
| 4,133,599 | A | | 1/1979 | Powell |
| 4,221,447 | A | * | 9/1980 | Powell ..... 439/823 |
| 4,269,472 | A | * | 5/1981 | Shaffer et al. ..... 439/847 |
| 4,275,948 | A | | 6/1981 | Gallusser et al. |
| 4,558,916 | A | | 12/1985 | Hehl |
| 4,734,064 | A | | 3/1988 | Knapp et al. |
| 4,865,567 | A | | 9/1989 | Neidich |
| 5,082,462 | A | | 1/1992 | Oswald, Jr. |
| 5,088,942 | A | | 2/1992 | Welsh et al. |
| 5,254,022 | A | | 10/1993 | Stuart |
| 5,332,459 | A | | 7/1994 | Imai et al. |
| 5,628,656 | A | | 5/1997 | Macioci et al. |
| 5,676,571 | A | * | 10/1997 | Matthews ..... 439/843 |
| 5,775,960 | A | | 7/1998 | Saito et al. |
| 2004/0192122 | A1 | | 9/2004 | Bischoff et al. |
| 2004/0219843 | A1 | | 11/2004 | Baker et al. |

OTHER PUBLICATIONS

Positronic Industries Inc. SGMC Series Female Contact Assembly.
Positronic Industries Inc. SGMC Series Retention Ring.
Positronic Industries Inc. PCS Series Female Contact.
Positronic Industries Inc. GMCT Series Spring Clip.

* cited by examiner

*Primary Examiner*—Briggitte R. Hammond
(74) *Attorney, Agent, or Firm*—Senniger Powers

(57) ABSTRACT

An electrical connector assembly has a first connector including at least one female electrical contact having a longitudinal axis, a terminal, and a socket body defining a socket. The socket body has an axial opening and a radial opening. A second connector has at least one male electrical contact having a mating portion with a diameter for engagement with the female contact to produce an electrical connection between the first contact and second contact. A clip is formed separately from the female contact and includes a contact arm. The clip is mounted on the female contact so that the contact arm of the clip projects into the socket through the radial opening in the socket body. The contact arm is positioned for engaging the male contact upon reception in the socket for use in making electrical connection between the female and male contacts.

30 Claims, 12 Drawing Sheets

ELECTRICAL CONTACT AND CONNECTOR ASSEMBLY

BACKGROUND OF THE INVENTION

This invention relates generally to the field of electrical connectors and more particularly to an electrical connector assembly having a female contact adapted to receive a male contact.

A variety of electrical connectors are commonly used in the art having conductive contacts that are interconnected for making an electrical connection between the connectors. Typically, one of the connectors has male (pin) contacts and the other connector has female (socket) contacts for receiving the male contacts of the other connector. The female contact and the male contact may be sized for an interference fit so that a secure electrical connection is made when the contacts are interconnected. Relying solely on the interference fit between the male and female contacts is highly dependent on manufacturing tolerances. Therefore, an interference fit can be unreliable in establishing electrical connection between the connectors and is not suitable for all applications, especially those requiring a highly reliable electrical connection.

In order to improve the reliability of the electrical connection of the male and female contacts, closed entry sockets on the female contacts are typically used. A closed entry socket contact limits the size of the mating contact to a predetermined dimension. This is achieved most commonly by a socket contact design that has a hole (opening) cut or formed in the receiving end of the contact. The material from which the hole (opening) is formed is solid and uniform around the entire perimeter of the hole (opening). If the size or orientation of the mating male contact is not correct, the two contacts will not be able to intermate as the receiving end of the socket contact will prohibit the male contact from entering the hole (opening).

The closed entry design may also be provided by a contact having a tubular shroud surrounding spring fingers at the mating end of the socket which are deflected in a radial direction upon insertion of the male contact. After insertion of the male contact, the spring fingers apply a holding force to the male contact making it more difficult for the contacts to disengage. The tubular shroud provides the closed entry feature of this contact design. Such existing closed entry contacts with spring fingers provide a more reliable electrical connection than contacts relying solely on the interference fit between the contacts, but the spring finger contacts are more costly to manufacture.

Another closed entry socket design with improved reliability includes a female contact having a radial opening and a spring clip received around the contact protruding into the radial opening. Typically, the spring clip has a dimple that projects through the radial opening and into a socket providing an interference with a male contact received in the socket. The dimples of this existing design require extensive machining and are spaced a significant distance from the initial point of entry of the male contact requiring a deeper insertion of the male contact before the electrical connection is made. This is undesirable in instances where sequenced electrical connection among mating contacts is required. After numerous intermating cycles over time, the dimples have been found to cause damage to the male contacts at the point of engagement with the dimple necessitating replacement of the contacts.

SUMMARY OF INVENTION

Among the several objects and features of the present invention may be noted the provision of an electrical connector having a reliable closed entry design; the provision of such an electrical connector which allows reduced insertion distance prior to electrical engagement of a male contact with a female contact; the provision of such an electrical connector which allows sequential mating of contacts; the provision of such an electrical connector which reduces damage to the male contact; the provision of such an electrical connector which allows use of more conductive and less expensive materials; and the provision of such an electrical connector which allows simplified and economical manufacturing. At least one of the preceding objects is met in whole or in part by the present invention described herein.

Generally, the electrical connector of the present invention comprises a first connector having at least one female electrical contact having a longitudinal axis, a terminal, and a socket body defining a socket. The socket body has an axial opening and a radial opening providing access to the socket. A second connector has at least one male electrical contact having a mating portion having a diameter and being adapted to be received through the axial opening into the socket of the female electrical contact for engagement of the male contact with the female contact to produce an electrical connection between the first contact and second contact. A clip is formed separately from the female contact and includes a contact arm. The clip is constructed and shaped for mounting on the female contact so that the contact arm of the clip projects into the socket through the radial opening in the socket body. The contact arm defines a contact surface closest to the longitudinal axis of the female contact when the clip is mounted thereon. The contact arm extends generally from one edge of the radial opening in the socket body to an opposite edge of the radial opening and is positioned for engaging the male contact upon reception in the socket for use in making electrical connection between the female and male contacts. The maximum spacing between the contact surface and a radially opposed portion of the socket body within the socket is less than the diameter of the mating portion of the male contact when received in the socket.

In another aspect, the present invention is also directed to a female electrical contact for an electrical connector assembly. The female electrical contact has a longitudinal axis and generally comprises a terminal and a socket body defining a socket and having an axial opening and a radial opening providing access to the socket. The axial opening is adapted to receive at least one male electrical contact for engagement of the male contact with the female contact to produce an electrical connection therebetween. A clip is formed separately from the socket body and includes a contact arm. The clip is constructed and shaped for mounting on the socket body so that the contact arm of the clip projects into the socket through the radial opening in the socket body. The contact arm defines a contact surface closest to the longitudinal axis of the female contact when the clip is mounted thereon. The contact surface extends generally from one edge of the radial opening in the socket body to an opposite edge of the radial opening and is generally free of discontinuities. The contact surface is positioned for engaging the male contact upon reception in the socket for use in making electrical connection between the female and male contacts.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
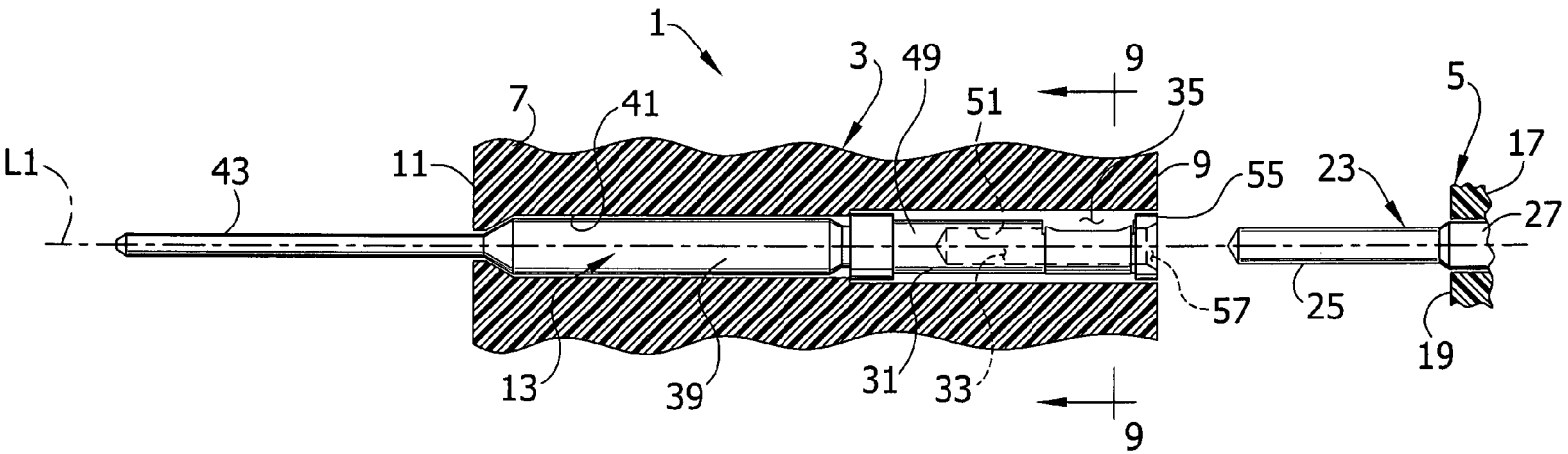
FIG. 1 is a fragmentary section of an electrical connector assembly of the present invention showing a first connector and a second connector at a disengaged position.

Referring now to the drawings, and in particular to FIG. 1, an electrical connector assembly 1 includes a first connector 3 and a second connector 5 (the reference numerals designating their subjects generally). The first connector 3 includes a first insulating body 7 having a front surface and a back surface and housing a female electrical contact, generally designated 13, having a longitudinal axis L1. The second connector 5 includes a second insulating body 17 having a front surface 19 and a back surface (not shown) and housing a male electrical contact, generally designated 23. The male contact 23 has a mating portion 25 of solid cylindrical construction protruding from the front surface 19 of the second insulating body 17 and a larger diameter portion 27 housed in the second insulating body. The male contact 23 may be hollow or have an exterior surface including discontinuities. However, in general the male contact 23 has an exterior surface sized and shaped for engagement with the female contact 13 to produce an electrical connection. The male contact 23 has a termination end (not shown) for electrical connection to a component of an electrical circuit (e.g., electronic device, power source, etc.). The female contact 13 and male contact 23 are adapted for interengagement to produce an electrical connection when the first connector 3 and second connector 5 are mated. Only one female contact 13 and male contact 23 in each connector 3, 5 are shown and described herein, but it is understood that the number of male and female contacts may be more than one.

The female contact 13 of the present invention has a socket body 31 defining a socket 33 housed in a front cavity 35 of the first insulating body 7, an intermediate portion 39 housed in a back cavity 41 of the first insulating body, and a terminal 43 protruding from the back surface 11 of the insulating body for electrical connection to a printed circuit board (not shown) or other component of an electrical circuit (e.g., electronic device, power source, etc.). It is understood that the terminal 43 of the socket body 31 may be otherwise shaped and arranged for connection to an electrical wire (not shown) via conventional electrical connection methods (e.g., solder, crimp, etc.) and that the terminal may be housed in the insulating body.

Figure 2:
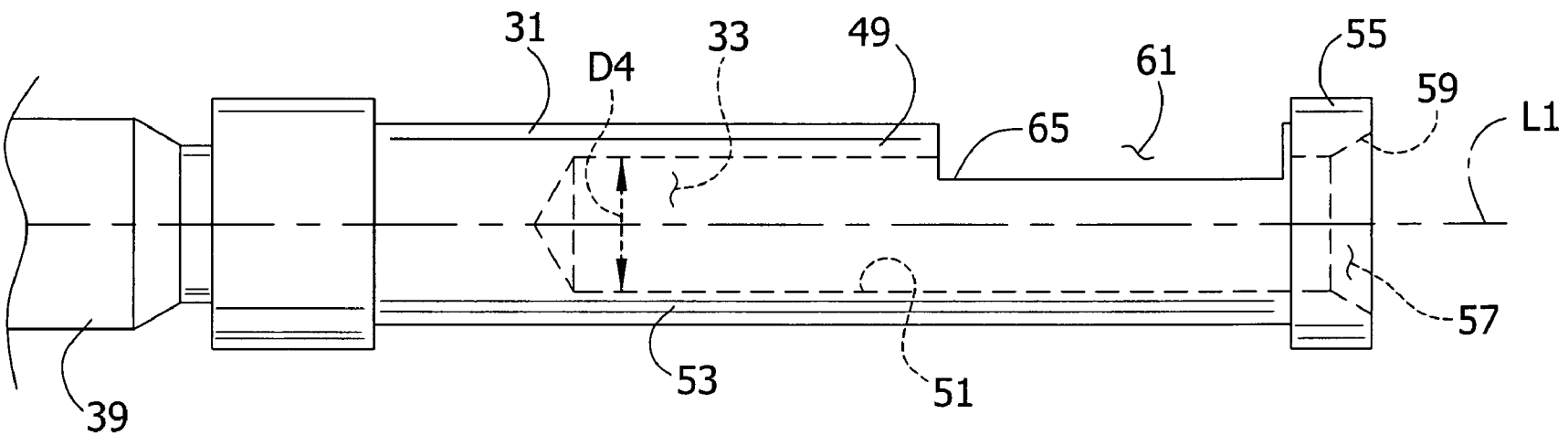
FIG. 2 is an enlarged fragmentary side elevation of a female contact of the first connector with a clip removed therefrom.
Figure 3:
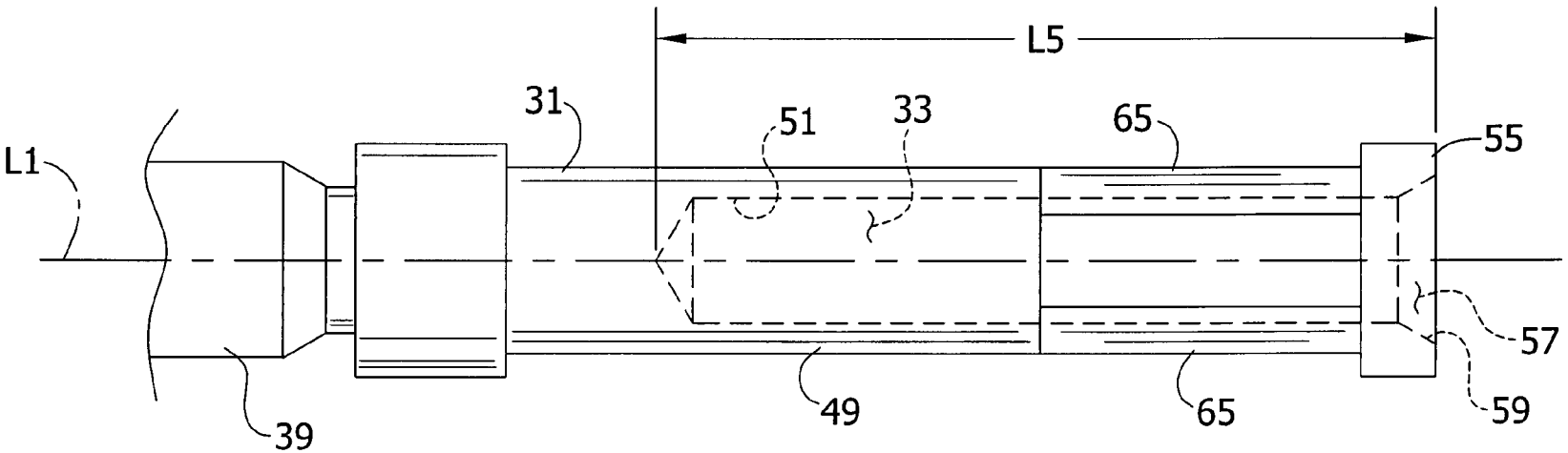
FIG. 3 is a fragmentary top plan of the female contact of FIG. 2.
Figure 4:
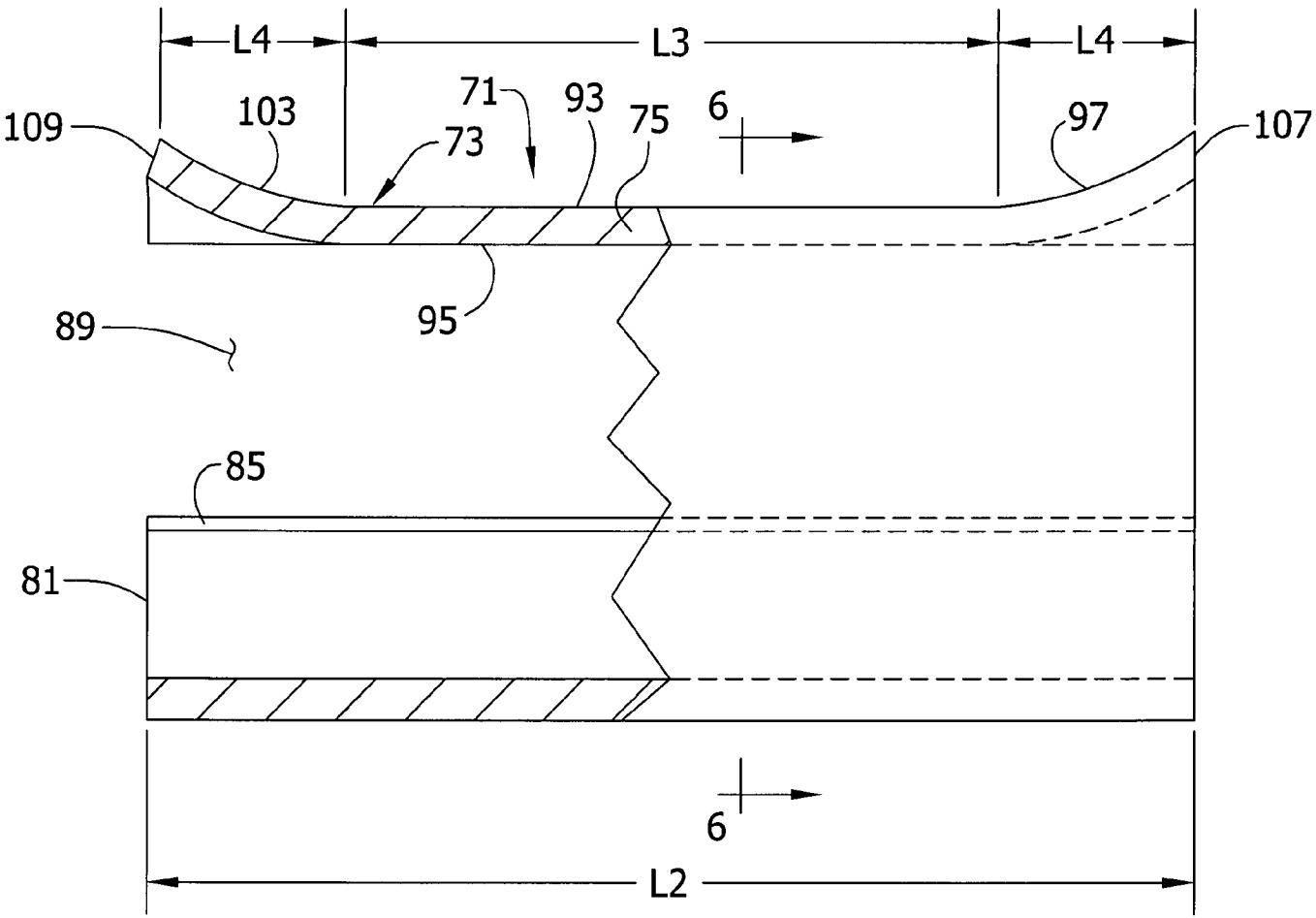
FIG. 4 is an enlarged side elevation of the clip of the first connector with a portion broken away to show the interior of the clip.

As shown in FIGS. 2 and 3, the socket body 31 is generally tubular having an exterior circumferentially extending surface 49 and an interior surface 51 (shown in phantom) that is shaped to receive the mating portion 25 of the male contact 23 of the second electrical connector 5. The socket body 31 has a diameter D4 (illustrated at a rear portion 53). It is understood that the diameter D4 of the socket body may range from approximately 0.032 inch (0.81 mm) to approximately 0.068 inch (1.7 mm) for contacts 13, 23 of conventional sizes (e.g., Size 22, Size 16, etc.) used in the electrical connector assembly 1. Upon insertion of the mating portion 25 of the male contact 23 into the socket 33, the outer surface of the male contact makes contact with the interior surface 51 of the socket body 31 so that electrical current flows from the male contact to the female contact 13 or vice versa. The socket body 31 is preferably made of a high-strength, non-elastic material (e.g., brass or other copper alloy) having high electrical conductivity. The material of the socket body 31 should be capable of withstanding frequent engagement and disengagement of the male and female contacts 23, 13 and the sliding contact between the mating portion 25 of the male contact and the interior surface 51 of the socket body throughout the life of the connector assembly 1.

As shown in FIGS. 1–3, the socket body 31 has a collar 55 that surrounds an axial opening 57 at the front end of the socket 33 that is shaped to receive the male contact 23 of the second connector 5. The collar 55 is sized to fit in the front cavity 35 of the insulating body 7 so that the socket 33 is centered in the cavity and aligned for mating with the male contact 23. The axial opening 57 in the collar 55 has a lead-in chamfer 59 which guides the tip of the mating portion 23 of the male contact 23 into the socket 33.

The socket body 31 has a radial opening 61 adjacent the collar 55 that extends longitudinally toward the terminal 43 of the female contact 13. In the illustrated embodiment, the radial opening 61 is shown at the top radial portion of the socket body 31, but it is understood that the radial opening may be otherwise located on the socket body (e.g., at either side or bottom of the socket body). As seen in FIG. 3, the socket body 31 has two external surfaces 65 extending the length of the radial opening 61 that form the opposite edges of the radial opening. In the illustrated embodiment, the surfaces 65 forming the opposite edges of the opening 61 are generally straight and coplanar but it is understood that the surfaces may be otherwise located and may be other than straight (e.g., contoured) without departing from the scope of this invention.

The connector assembly 1 further includes a clip, generally indicated 71, formed separately from the female contact 13 and mounted on the socket body 31. As shown in FIGS. 4–7, the clip 71 has a generally elongate body 73 with a C-shaped cross-sectional shape adapted for snap-on connection to the socket body 31. The clip 71 has a contact arm 75 defining a first radial edge 79 of the clip and a curved attachment portion 81 defining a second radial edge 85 of the clip. A radial gap 89 extends the length of the clip 71 between the first radial edge 79 and second radial edge 85. The socket body 31 passes through the (expanded) radial gap 89 when the clip 71 is snapped onto the socket body.

Figure 7:
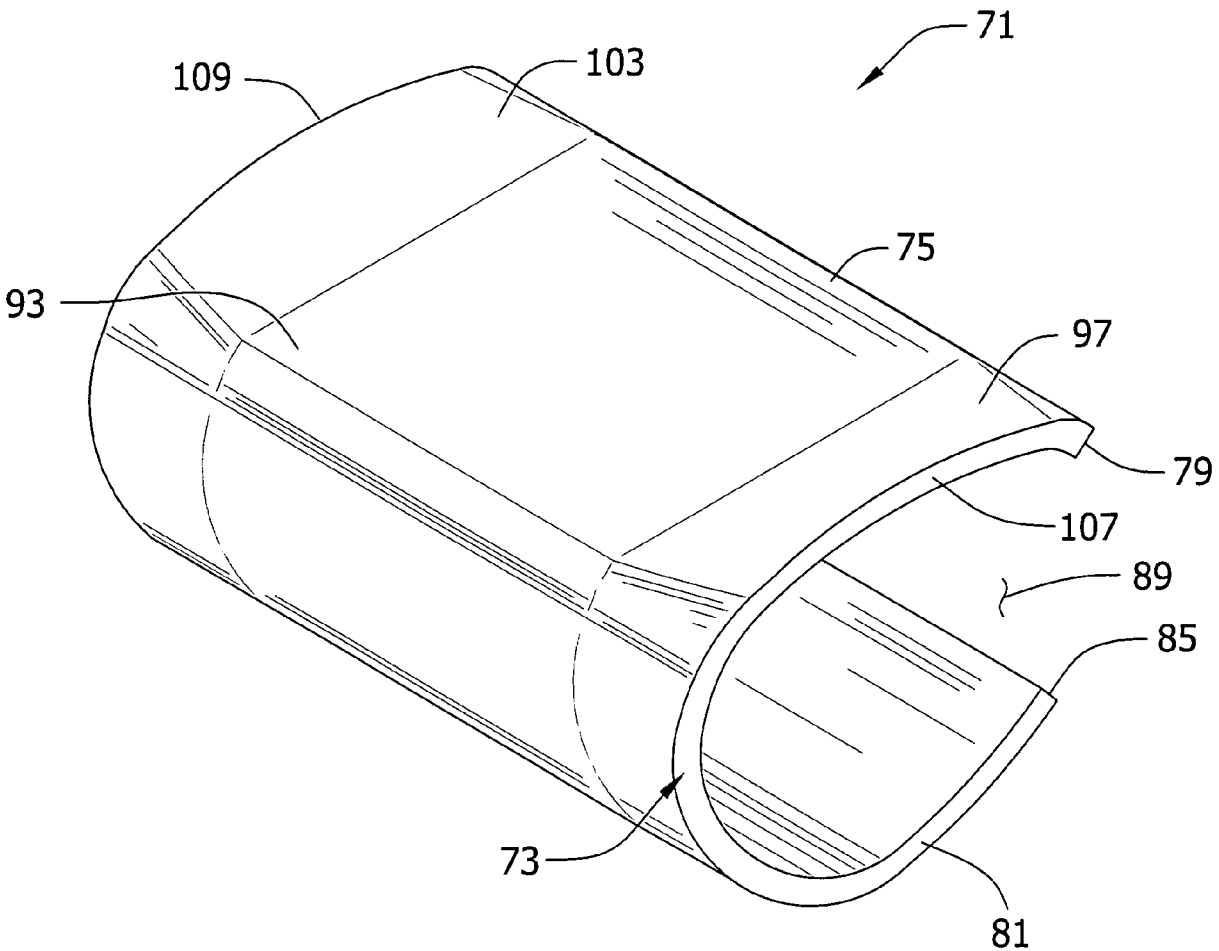
FIG. 7 is a perspective of the clip.

As shown in FIG. 7, the contact arm 75 has a generally flat portion 93 forming a contact surface 95, a first (front) upwardly flared portion 97 adjacent a front end of the contact surface, and a second (back) upwardly flared portion 103 adjacent a back end of the contact surface. Each of the flared portions 97, 103 is upwardly struck from the contact arm 75, with the first flared portion including a forward longitudinal edge 107 of the arm and the second flared portion including a rearward longitudinal edge 109 of the arm. The front flared portion 97 facilitates movement of a leading edge of the male contact 23 past the forward longitudinal edge of the contact arm 75. The back flared portion 103 may be omitted without departing from the scope of the present invention. However, by providing flared portions 97, 103 at both longitudinal ends, the clip 71 can be snapped onto the female contact 13 from either side of the radial opening 61 and still present a flared surface adjacent the axial opening 57 of the female contact. In the illustrated embodiment, the contact surface 95 of the clip 71 is free of any, bends, discontinuities, or formations projecting outward from the contact surface along the length L3 of the contact surface.

Figure 6:
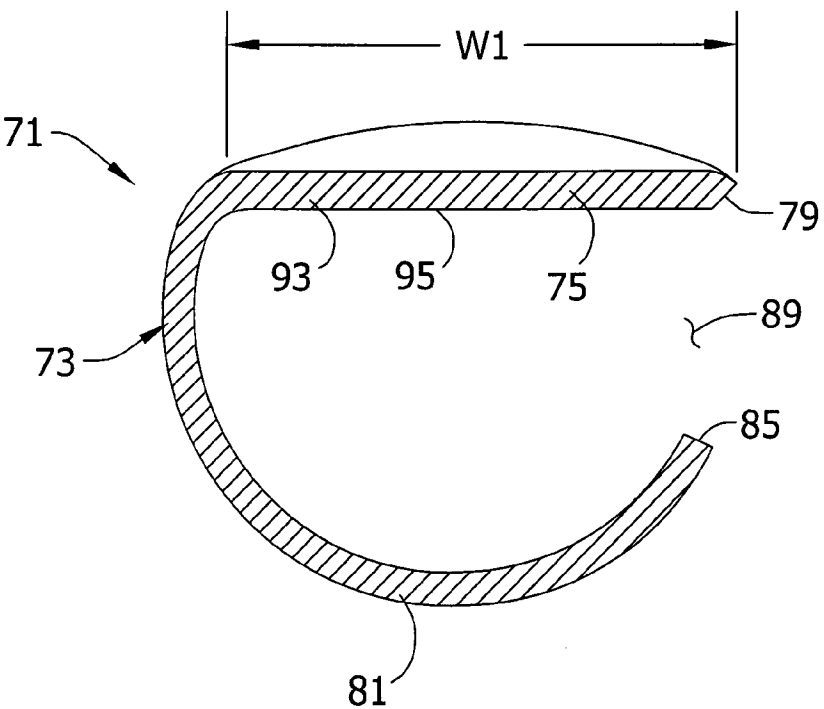
FIG. 6 is a cross-section of the clip taken in the plane including line 6—6 of FIG. 4.
Figure 5:
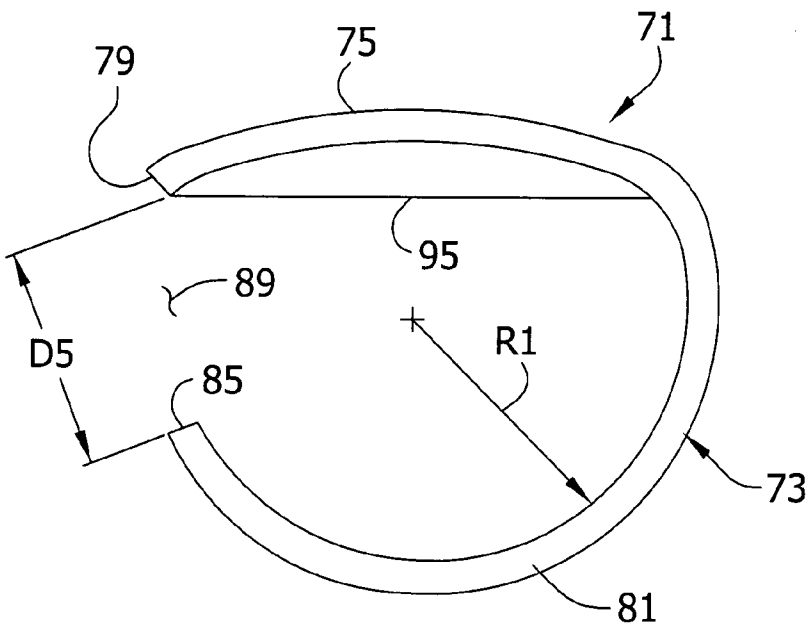
FIG. 5 is an end elevation of the clip.
Figure 8:
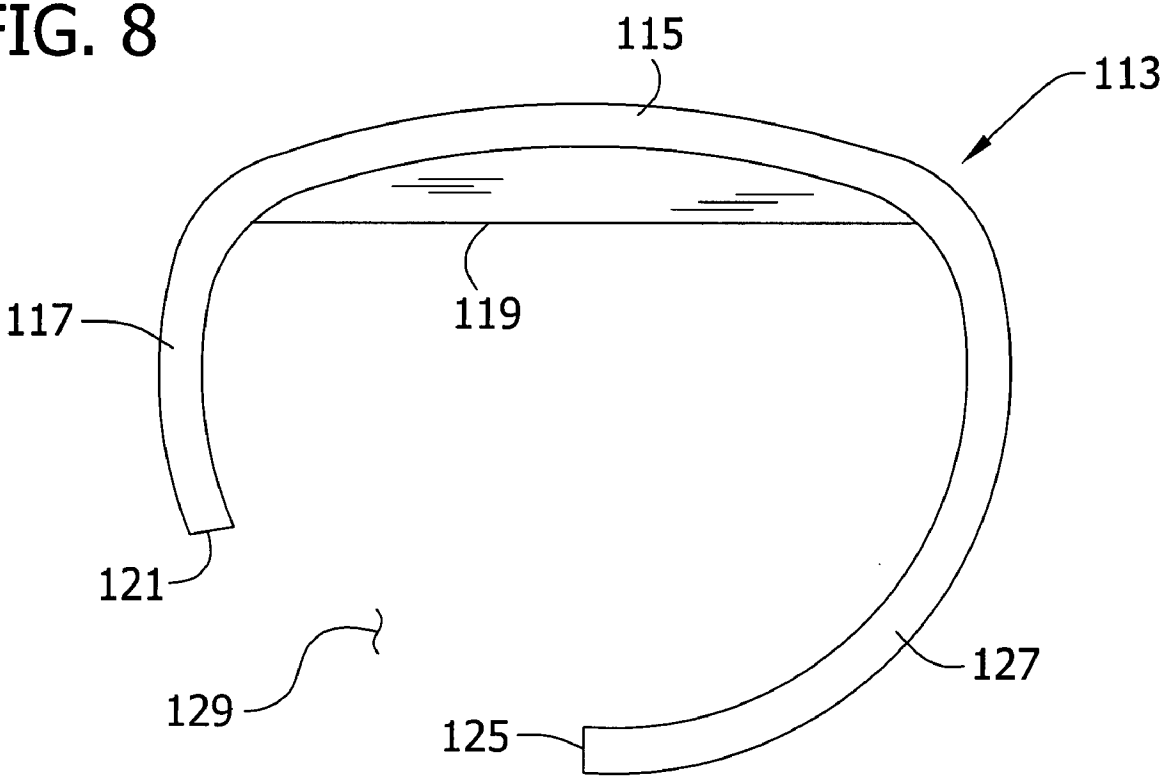
FIG. 8 is an end elevation of an alternate embodiment of the clip.

In the embodiment of FIGS. 5–7, the radial edge 97 of the contact arm 71 is generally adjacent the flat contact surface 95 of the clip. In an alternative embodiment shown in FIG. 8, a clip 113 may have a contact arm 115 having a radially extending portion 117 adjacent the flat contact surface 119 of the clip so that a radial edge 121 of the clip is radially spaced from the contact surface. Also, in the embodiment of FIG. 8, the radial edge 125 of a curved attachment portion 127 is located at the bottom of the clip 113 such that a gap 129 between the radial edge 121 of the contact arm 115 and the radial edge of the attachment portion is angularly positioned closer to the bottom surface of the clip. It is understood that the clip 71, 113 may have other shapes and configurations without departing from the scope of this invention.

Figure 9:
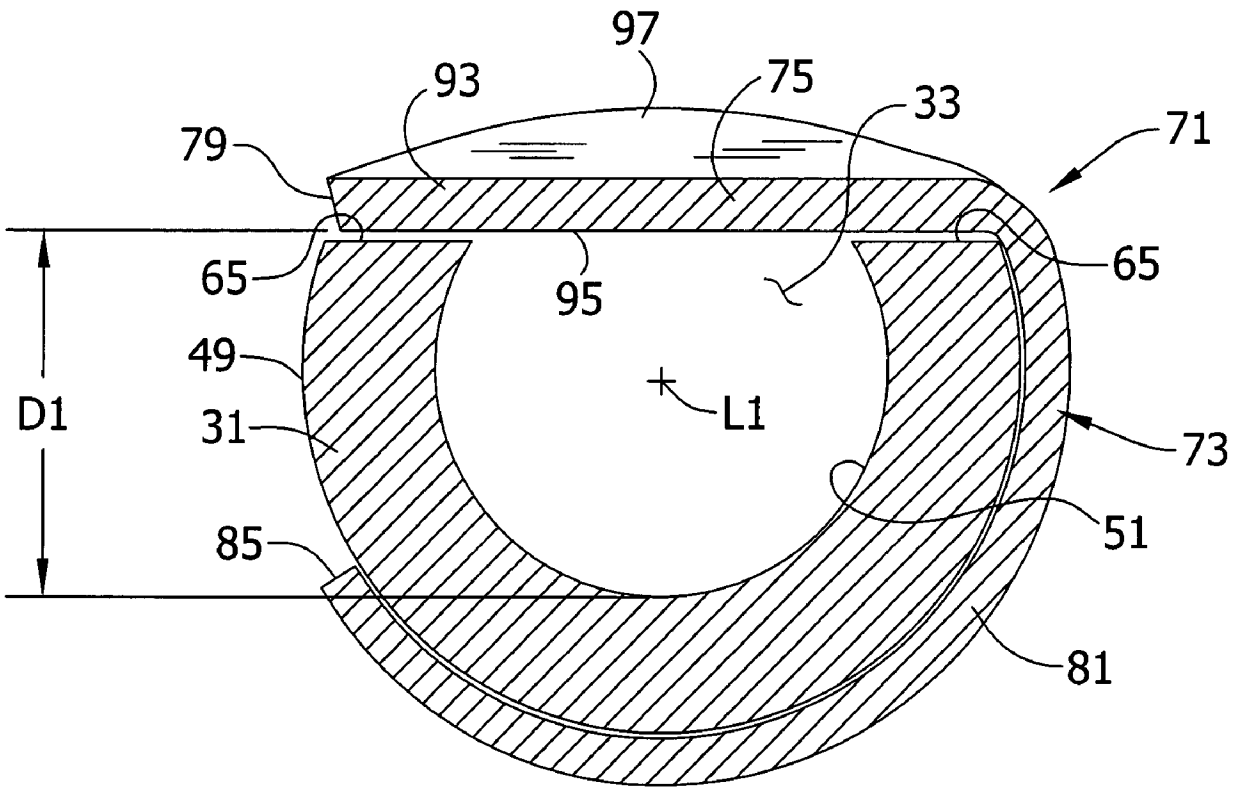
FIG. 9 is a cross-section of the female contact clip taken along the plane including line 9—9 of FIG. 1 with an insulating body of the connector removed.

As shown in FIG. 9, the attachment portion 81 of the clip 71 is sized and shaped for extending around a portion of the exterior circumferentially extending surface 49 of the socket body 31, and generally conforms to the shape of the exterior surface. The clip 71 is attached to the socket body 31 by positioning the clip on the socket body such that the socket body is received in the radial gap 89 of the clip and the curved attachment portion 81 of the clip extends around the exterior surface 49 of the socket body. The clip 71 is mounted on the socket body 31 such that the contact arm 75 of the clip projects into the socket 33 through the radial opening 61 in the socket body. The clip 71 is positioned such that the contact surface 95 on the flat portion of the contact arm 75 is closest to the longitudinal axis L1 of the female contact 13. Moreover, the maximum distance D1 between the contact surface 95 and a radially opposed portion of the interior surface 51 of the socket body 31 is less than the diameter D2 (FIG. 10A) of the mating portion 25 of the male contact 23. In one embodiment, the maximum distance D1 may range from approximately 0.025 inch (0.64 mm) to 0.0285 inch (0.72 mm), and in one embodiment is approximately 0.027 inch (0.69 mm), and the diameter D2 of the mating portion 25 may range from approximately 0.0295 inch (0.75 mm) to 0.0305 inch (0.77 mm), and in one preferable embodiment is approximately 0.030 inch (0.76 mm). It is understood that the above-noted dimensions may vary from the above-stated ranges depending on the size of the contacts 13, 23 in the electrical connector assembly 1.

The contact surface 95 of the clip 71 extends laterally from one of the external surfaces 65 forming the radial opening 61 of the socket body 31 to the other external surface of the socket body so as to define the top wall of the socket 33. In the illustrated embodiment, the contact surface 95 is substantially planar and generally free of discontinuities and surface formations projecting into the socket 33 and is positioned for engaging the male contact 23 upon reception of the mating portion 25 of the male contact in the socket to make an electrical connection between the female contact 13 and male contact.

Figure 10:
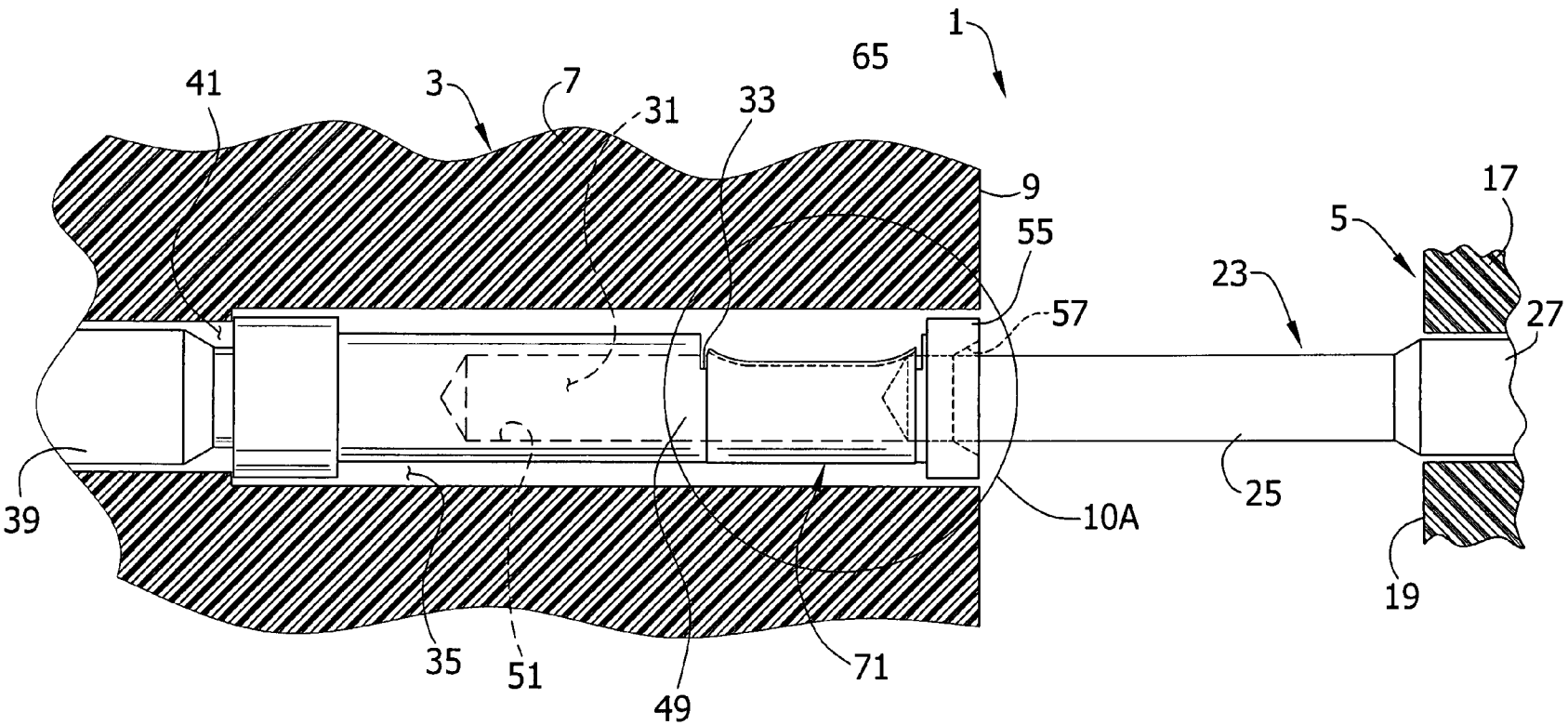
FIG. 10 is an enlarged fragmentary section showing a male contact partially inserted into a female contact of the assembly.
Figure 10A:
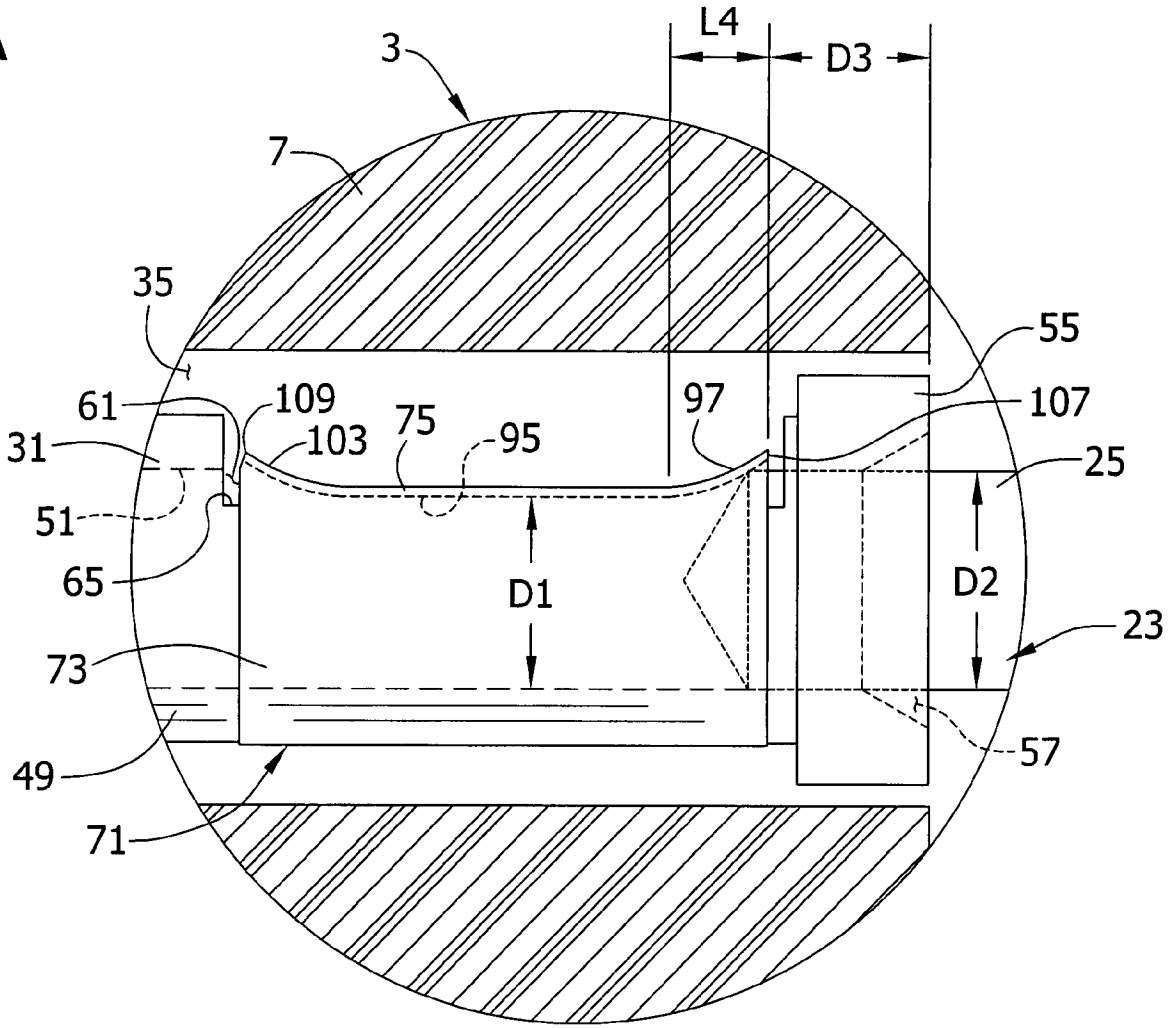
FIG. 10A is an enlarged detail of FIG. 10.
Figure 11:
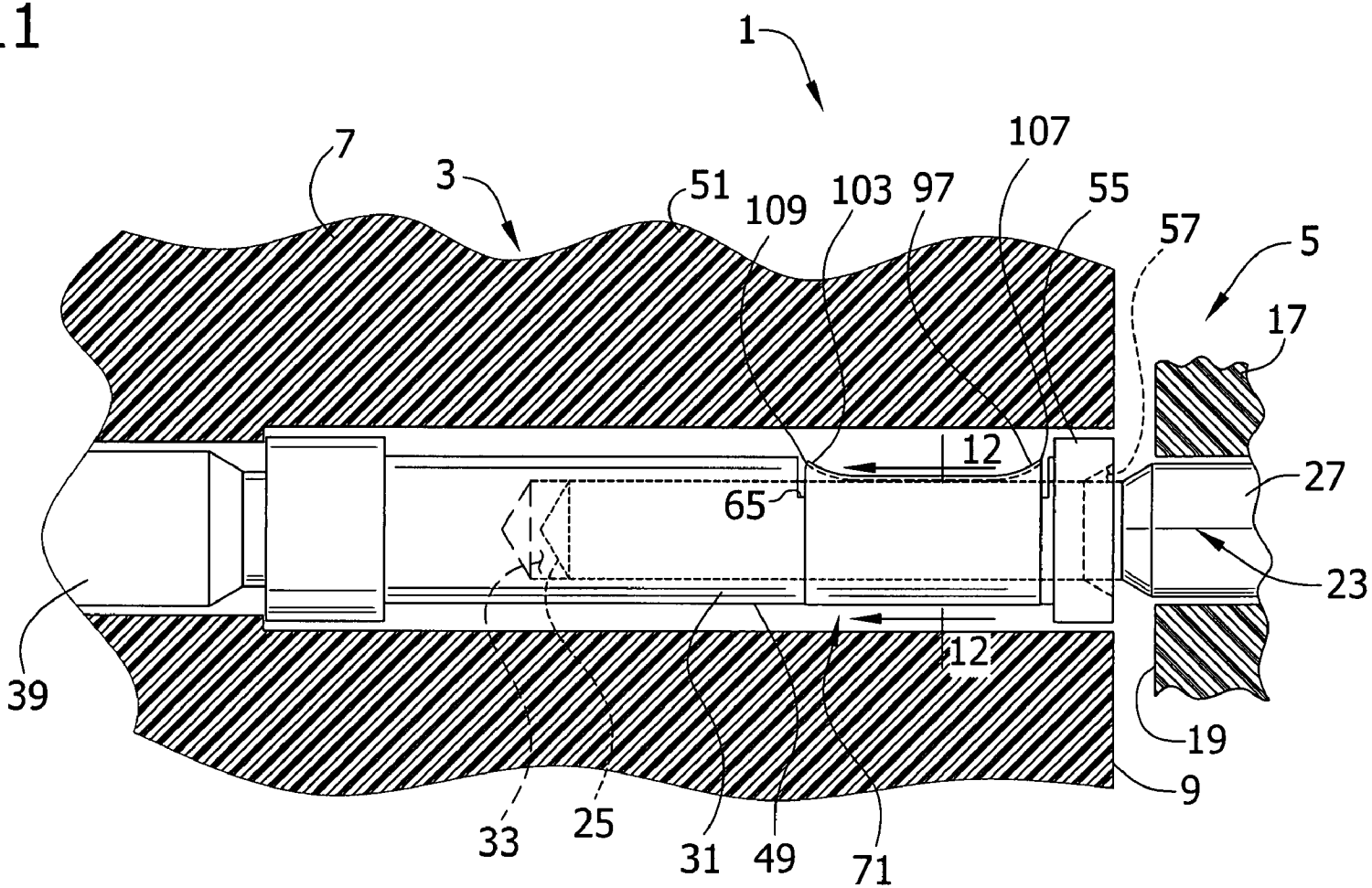
FIG. 11 is a view similar to FIG. 10 but showing the male contact further inserted into the female contact.
Figure 12:
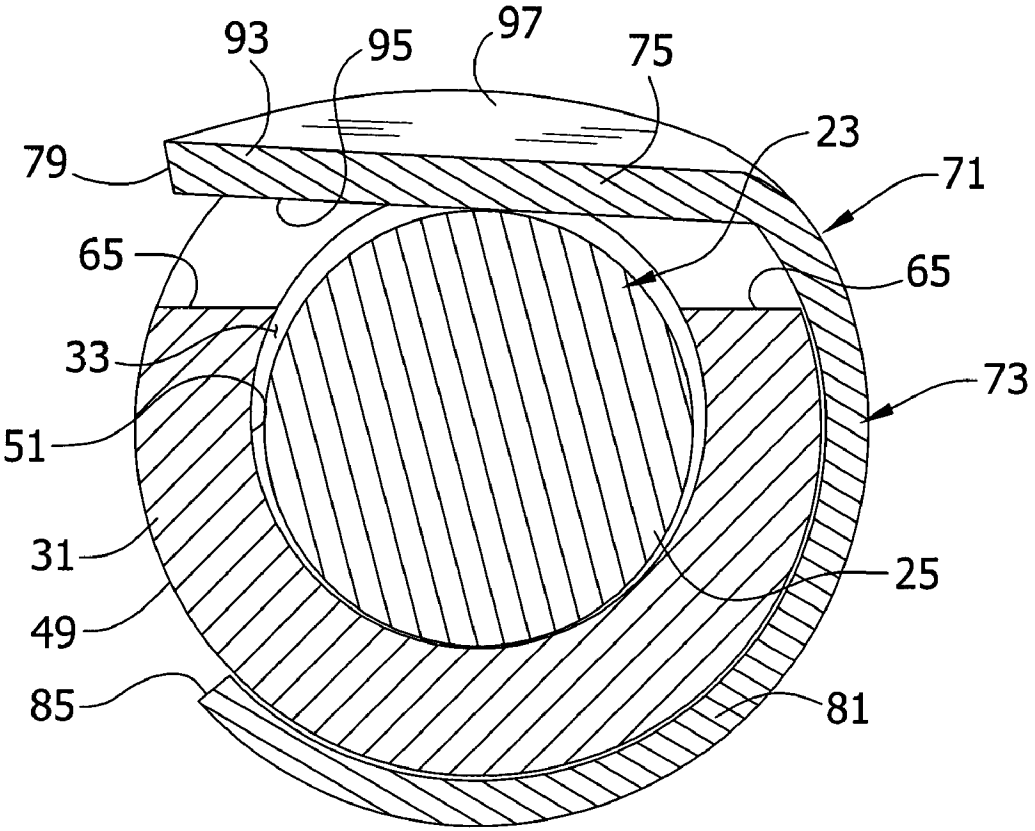
FIG. 12 is a cross-section of the female contact, clip and male contact taken along the plane including line 12—12 of FIG. 11 with the insulating body of the first connector removed.

The interengagement of the first connector 3 and the second connector 5 is illustrated in FIGS. 10 thru 12. FIGS. 10 and 10A show the mating portion 25 of the male contact 23 of the second connector 5 in initial engagement with the socket body 31 of the first connector 3. The front flared portion 97 of the contact arm 75 of the clip 71 is positioned adjacent the collar 55 of the socket body 31 that surrounds the radial opening 61 of the socket 33 so that the forward longitudinal edge 107 of the clip is closely adjacent the axial opening 57 of the socket. Because the clip 71 is positioned in close proximity to the axial opening 57 of the socket 33, the male contact 23 and the female contact 13 make electrical connection earlier (i.e., with less insertion of the male contact into the female contact). The position of the clip 71 near the axial opening 57 of the socket 33 allows a ground contact (not shown) of the second connector 5 to have a mating portion closer in length to the mating portions 25 of other contacts 23 of the connector. In some conventional electrical connectors, such a ground contact must be significantly longer than the other contacts of the connector to assure that the ground contact makes electrical connection before the remaining contacts enter the socket. Also, other contacts 23 in the second connector 5 may have different lengths to allow sequential mating of the contacts with the female contacts 13 of the first connector 3. Sequential mating of the connectors 3, 5 results from the male contacts making electrical connection with the female contacts 23 at different times during mating of the connectors.

As shown in FIG. 10A, the forward longitudinal edge 107 of the contact arm 75 and the axial opening 57 of the socket body 31 are spaced apart a distance D3. The distance D3 may range from approximately 0.019 inch (0.48 mm) to 0.034 inch (0.86 mm) for some common contact sizes and in one embodiment is approximately 0.021 inch (0.53 mm). Referring to FIG. 3, the sockets 33 may be sized to have an axial length L5 ranging from approximately 0.185 inch (4.7 mm) to 0.450 inch (11.4 mm). In one embodiment, the length L5 is approximately 0.197 inch (5.0 mm). In one embodiment, the D3/L5 ratio is preferably less than or equal to approximately 20 percent and may range from approximately 5 to 20 percent. In one embodiment, the distance D3 is approximately 11 percent of the length L5 of the socket 33. Preferably, this ratio of D3/L5 should be as low as possible to allow a greater flexibility in the number of levels of sequential mating and greater tolerance in the design of the ground contact. A contact 13 having a smaller distance D3 allows electrical contact with the male contact 23 to be made with less axial insertion length of the male contact so a greater amount of axial contact length of the socket 33 is available for sequential mating. It is understood that all dimensional information set forth herein is exemplary only and is not intended to limit the broadest scope of the invention.

As shown in FIGS. 10 and 10A, the mating portion 25 of the male contact 23 first engages the front flared edge margin 107 of the clip 71 making initial electrical connection between the male contact 23 and female contact 13. The initial electrical connection between the male and female contacts 23, 13 occurs prior to full insertion of the mating portion 25 of the male contacts 23 into the socket 33 of the female contact. As shown in FIGS. 11 and 12, the advancement of the mating portion 25 of the male contact 23 in the socket 33 causes the mating portion to engage the contact arm 75 of the clip 71. The clip 71 is positioned such that the engagement of the mating portion 25 with the contact surface 95 of the clip forces the male contact 23 into electrical connection with the bottom portion of the interior surface 51 of the socket body 31. As the mating portion 25 is advanced in the socket 33, the contact arm 75 flexes upward to the position shown in FIG. 12. The contact arm 75 provides a downward biasing force that holds the mating portion 25 of the male contact 23 against the interior surface 51 of the socket body 31 so that the male and female contacts 23, 13 are in electrical connection. As the first and second connectors 3, 5 are brought together from the intermediate position of FIG. 10 to the more fully connected position of FIG. 11, the mating portion 25 of the male contact 23 is further advanced in the socket 33 so that more of the surface area of the mating portion is in electrical contact with the interior surface 51 of the socket body 31.

One advantage of the present invention is that the male contact 23 engages the flared portion 97 that guides the contact into engagement with the flat contact surface 95 of the contact arm 71 (see FIG. 10A). The flared portion 97 provides a smooth, large radius bend that prevents the male contact 23 from being damaged when inserted in the socket body 31.

In one embodiment the clip 71 is made from a resilient and electrically conductive material (e.g., beryllium copper or other suitable metal) and the socket body 31 is made from a rigid and electrically conductive material (e.g., brass, other copper alloy, or other suitable metal). Because only the clip 71 of the female socket 33 of the present invention flexes upon insertion of the male contact 23 into the socket, the socket body 31 may be made from a relatively rigid material having higher electrical conductivity resulting in better electrical conduction between the first and second connector 3, 5. On the other hand, the clip 71 can be made of a resilient, malleable material of lower electrical conductivity. Thus, the clip 71 can be made from conventional sheet metal forming processes with the socket body 31 being precision machined from a solid bar stock. The electrical conductivity of the clip 71 can be lower because the socket body 31, not the clip, is relied on for conducting electricity.

In the illustrated embodiment, the clip 71 has a longitudinal length L2 (FIG. 4) of approximately 0.080 inch (2.0 mm). The flat portion 93 of the contact arm 75 has a width W1 (FIG. 6) of approximately 0.045 inch (1.1 mm), a length L3 (FIG. 4) of approximately 0.060 inch (1.5 mm) which is approximately 75 percent of the total length of the clip 71. Each of the flared longitudinal edge portions 97, 103 of the contact arm 75 has a length L4 (FIG. 4) of approximately 0.010 inch (0.26 mm). The curved attachment portion 81 of the clip 71 has a radius R1 (FIG. 5) of approximately 0.024 inch (0.60 mm) with the gap 89 between the free end portion 79 of the contact arm 75 and the free end portion 85 of the attachment portion being a distance D5 (FIG. 5) of approximately 0.022 inch (0.56 mm).

In the illustrated embodiment, the socket 33 of the socket body 31 has a diameter D4 (FIG. 2) of approximately 0.033 inch (0.84 mm) and the forward longitudinal edge 107 of the contact arm 75 and the axial opening 57 of the socket 33 are spaced apart a distance D3 (FIG. 10A) of approximately 0.021 inch (0.53 mm) which is approximately 64 percent of the socket diameter D4. In one embodiment, the distance D3 may range from approximately 44 to 72 percent of the socket diameter D4. The sum of the length L4 of the front flared longitudinal edge portion 97 and the distance D3 is approximately 94 percent of the diameter D4 of the socket 33. In one embodiment, the sum of L4 and D3 may range from approximately 68 percent to approximately 106 percent. In one embodiment, the length L4 of the front flared longitudinal edge portion 97 may be less than or equal to approximately 40 percent of the diameter D4 of the socket 33, or may range from approximately 24 percent to approximately 34 percent of the diameter D4, or may be approximately 30 percent of the diameter D4.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. Further, all dimensional information set forth herein is exemplary only and is not intended to limit the scope of the invention. It is understood that any of the particular embodiments of the present invention may include one or more of the aspects or features of the invention as described herein and illustrated in the drawings.

What is claimed is:

1. An electrical connector assembly comprising a first connector having at least one female electrical contact having a longitudinal axis, a terminal, and a socket body defining a socket having a diameter, the socket body having an axial opening and a radial opening providing access to the socket, the socket body comprising two external surfaces forming edges in opposed to each other in a circumferential direction about the longitudinal axis of the contact;

a second connector having at least one male electrical contact including a mating portion having a diameter and being adapted to be received through the axial opening into the socket of the female electrical contact for engagement of the male contact with the female contact to produce an electrical connection between the first contact and second contact, a clip formed separately from the female contact and including a contact arm, the clip being constructed and shaped for mounting on the female contact so that the contact arm of the clip projects into the socket through the radial opening in the socket body, the contact arm defining a contact surface closest to the longitudinal axis of the female contact when the clip is mounted thereon, the contact arm being free of formations projecting from the contact surface into the socket, the contact surface extending generally from one of the circumferentially opposed edges of the radial opening in the socket body to the opposite circumferentially opposed edge of the radial opening and being positioned for engaging the male contact upon reception in the socket for use in making electrical connection between the female and male contacts, the maximum spacing between the contact surface and a radially opposed portion of the socket body within the socket being less than the diameter of the mating portion of the male contact when received in the socket, the clip comprising a curved attachment portion, the contact arm and curved attachment portion being sized and shaped for extending around an exterior circumferentially extending surface of the socket body to attach the clip to the socket body.

2. The electrical connector assembly set forth in claim 1 wherein the clip is adapted for snap-on connection to the socket body.

3. The electrical connector assembly set forth in claim 1 wherein the contact surface lies in a plane extending from one of the circumferentially opposed edges of the radial opening to the opposite circumferentially opposed edge thereof when the clip is mounted on the female contact.

4. The electrical connector assembly set forth in claim 1 further comprising plural female contacts in the first connector and plural male contacts in the second connector, each of the female contacts having the same construction and including a clip having the same construction as the clip of claim 1.

5. The electrical connector assembly set forth in claim 1 wherein the two external surfaces defining the circumferentially opposed edges of the radial opening are substantially co-planar.

6. The electrical connector assembly set forth in claim 1 wherein the contact arm further comprises a flat portion including the contact surface and a flared portion including a forward longitudinal edge of the contact arm, the flared portion extending out of plane with the flat portion and generally radially outwardly from the longitudinal axis of the female contact when mounted thereon.

7. The electrical connector assembly set forth in claim 6 wherein the flared portion constitutes a first flared portion, and wherein the contact arm further comprises a second flared portion including a rearward longitudinal edge of the contact arm, the second flared portion extending out of plane with the flat portion and generally radially outwardly from the longitudinal axis of the female contact when mounted thereon.

8. The electrical connector assembly set forth in claim 6 wherein said flared portion has an axial length, the axial length being less than or equal to approximately 40 percent of the socket diameter.

9. The electrical connector assembly set forth in claim 1 wherein the clip is made of a first material and the socket body is made of a second material, the first material being more resilient than the second material.

10. The electric connector assembly set forth in claim 9 wherein the second material has a greater electrical conductivity than the first material.

11. The electrical connector assembly set forth in claim 9 wherein the clip is made of beryllium copper and said socket body is made of copper alloy.

12. A female electrical contact for an electrical connector assembly, the female electrical contact having a longitudinal axis and comprising:

a terminal, a socket body defining a socket and having an axial opening and a radial opening providing access to the socket, the axial opening being adapted to receive at least one male electrical contact for engagement of the male contact with the female contact to produce an electrical connection therebetween, the socket body comprising two external surfaces forming edges in opposed to each other in a circumferential direction about the longitudinal axis of the contact;

a clip formed separately from the socket body and including a contact arm, the clip being constructed and shaped for mounting on the socket body so that the contact arm of the clip projects into the socket through the radial opening in the socket body, the contact arm defining a contact surface closest to the longitudinal axis of the female contact when the clip is mounted thereon, the contact arm being free of formations projecting from the contact surface into the socket, the contact surface extending generally from one of the circumferentially opposed edges of the radial opening in the socket body to the opposite circumferentially opposed edge of the radial opening and being generally free of discontinuities, the contact surface being positioned for engaging the male contact upon reception in the socket for use in making electrical connection between the female and male contacts, the clip comprising a curved attachment portion, the contact arm and curved attachment portion being sized and shaped for extending around an exterior circumferentially extending surface of the socket body to attach the clip to the socket body.

13. The female electrical contact set forth in claim 12 wherein the clip is generally C-shaped in cross section and is adapted for snap-on connection to the socket body.

14. The female electrical contact set forth in claim 12 wherein the contact surface lies in a plane extending from one of the circumferentially opposed edges of the radial opening to the opposite circumferentially opposed edge thereof when the clip is mounted on the socket body.

15. The female electrical contact set forth in claim 12 wherein the male contact has a diameter and wherein a maximum spacing between the contact surface and the socket body within the socket is less than the diameter of the male contact.

16. The female electrical contact set forth in claim 12 wherein the contact arm further comprises a flat portion including the contact surface and a flared portion including a forward longitudinal edge of the contact arm, the flared portion extending out of plane with the flat portion and generally radially outwardly from the longitudinal axis of the female contact when mounted on said socket body.

17. The female electrical contact set forth in claim 16 wherein the flared portion constitutes a first flared portion, and wherein the contact arm further comprises a second flared portion including a rearward longitudinal edge of the contact arm, the second flared portion extending out of plane with the flat portion and generally radially outwardly from the longitudinal axis of the female contact when mounted on said socket body.

18. The female electrical contact set forth in claim 16 wherein said socket has a diameter and said flared portion has an axial length, the axial length being less than or equal to approximately 40 percent of the socket diameter.

19. The female electrical contact set forth in claim 12 wherein the clip is made of a first material and the socket body is made of a second material, the first material being more resilient than the second material.

20. The female electrical contact set forth in claim 19 wherein the second material has a greater electrical conductivity than the first material.

21. The female electrical contact set in claim 19 wherein the clip is made of beryllium copper and said socket body is made of copper alloy.

22. A female electrical contact for an electrical connector assembly, the female electrical contact having a longitudinal axis and comprising:

a terminal, a socket body defining a socket having a diameter, the socket body having an axial opening and a radial opening providing access to the socket, the axial opening being adapted to receive at least one male electrical contact for engagement of the male contact with the female contact to produce an electrical connection therebetween;

a clip formed separately from the socket body and including a contact arm, the clip being constructed and shaped for mounting on the socket body so that the contact arm of the clip projects into the socket through the radial opening in the socket body, the contact arm defining a contact surface closest to the longitudinal axis of the female contact when the clip is mounted thereon and being positioned for engaging the male contact upon reception in the socket for use in making electrical connection between the female and male contacts, the clip having a flared portion including a forward longitudinal edge of the contact arm, the clip comprising a curved attachment portion, the contact arm and curved attachment portion being sized and shaped for extending around an exterior circumferentially extending surface of the socket body to attach the clip to the socket body, wherein said contact surface comprises a flat portion of the clip, the flared portion extending out of plane with the flat portion and generally radially outwardly from the longitudinal axis of the female contact when mounted on the socket body.

23. The female electrical contact set forth in claim 22 wherein the contact surface extends generally from one edge of the radial opening in the socket body to an opposite edge of the radial opening and is generally free of discontinuities and formations projecting from the contact surface into the socket.

24. The female electrical contact set forth in claim 22 wherein the clip is adapted for snap-on connection to the socket body.

25. The female electrical contact set forth in claim 22 wherein the clip is made of a first material and the socket body is made of a second material, the first material being more resilient than the second material.

26. The female electrical contact set forth in claim 25 wherein the second material has a greater electrical conductivity than the first material.

27. The female electrical contact set forth in claim 25 wherein the clip is made of beryllium copper and said socket body is made of copper alloy.

28. A female electrical contact for an electrical connector assembly, the female electrical contact having a longitudinal axis and comprising:

a terminal, a socket body defining a socket having a diameter, the socket body having an axial opening and a radial opening providing access to the socket, the axial opening being adapted to receive at least one male electrical contact for engagement of the male contact with the female contact to produce an electrical connection therebetween;

a clip formed separately from the socket body and including a contact arm, the clip being constructed and shaped for mounting on the socket body so that the contact arm of the clip projects into the socket through the radial opening in the socket body, the contact arm defining a contact surface closest to the longitudinal axis of the female contact when the clip is mounted thereon and being positioned for engaging the male contact upon reception in the socket for use in making electrical connection between the female and male contacts, the clip having a flared portion including a forward longitudinal edge of the contact arm, the clip comprising a curved attachment portion, the contact arm and curved attachment portion being sized and shaped for extending around an exterior circumferentially extending surface of the socket body to attach the clip to the socket body, wherein said flared portion has an axial length, the axial length being less than or equal to approximately 40 percent of the socket diameter.

29. An electrical connector assembly comprising a first connector having at least one female electrical contact having a longitudinal axis, a terminal, and a socket body defining a socket having a diameter, the socket body having an axial opening and a radial opening providing access to the socket;

a second connector having at least one male electrical contact including a mating portion having a diameter and being adapted to be received through the axial opening into the socket of the female electrical contact for engagement of the male contact with the female contact to produce an electrical connection between the first contact and second contact, a clip formed separately from the female contact and including a contact arm, the clip being constructed and shaped for mounting on the female contact so that the contact arm of the clip projects into the socket through the radial opening in the socket body, the contact arm defining a contact surface closest to the longitudinal axis of the female contact when the clip is mounted thereon, the contact surface extending generally from one edge of the radial opening in the socket body to an opposite edge of the radial opening and being positioned for engaging the male contact upon reception in the socket for use in making electrical connection between the female and male contacts, the maximum spacing between the contact surface and a radially opposed portion of the socket body within the socket being less than the diameter of the mating portion of the male contact when received in the socket, the contact arm comprising a flat portion including the contact surface, a first flared portion including a forward longitudinal edge of the contact arm, and a second flared portion including a rearward longitudinal edge of the contact arm, the first and second flared portions extending out of plane with the flat portion and generally radially outwardly from the longitudinal axis of the female contact when mounted thereon.

30. A female electrical contact for an electrical connector assembly, the female electrical contact having a longitudinal axis and comprising:

a terminal, a socket body defining a socket and having an axial opening and a radial opening providing access to the socket, the axial opening being adapted to receive at least one male electrical contact for engagement of the male contact with the female contact to produce an electrical connection therebetween;

a clip formed separately from the socket body and including a contact arm, the clip being constructed and shaped for mounting on the socket body so that the contact arm of the clip projects into the socket through the radial opening in the socket body, the contact arm defining a contact surface closest to the longitudinal axis of the female contact when the clip is mounted thereon, the contact surface extending generally from one edge of the radial opening in the socket body to an opposite edge of the radial opening and being generally free of discontinuities, the contact surface being positioned for engaging the male contact upon reception in the socket for use in making electrical connection between the female and male contacts, the contact arm comprising a flat portion including the contact surface, a first flared portion including a forward longitudinal edge of the contact arm, and a second flared portion including a rearward longitudinal edge of the contact arm, the first and second flared portions extending out of plane with the flat portion and generally radially outwardly from the longitudinal axis of the female contact when mounted thereon.

* * * * *